US007631873B2

(12) United States Patent
Scriven

(10) Patent No.: US 7,631,873 B2
(45) Date of Patent: Dec. 15, 2009

(54) SYSTEMS AND METHODS FOR PLAYING A CARD MATCH GAME

(75) Inventor: Dale Reinhart Scriven, 11545 Joyceton Dr., Upper Marlboro, MD (US) 20774

(73) Assignee: Dale Reinhart Scriven, Upper Marlboro, MD (US)

( * ) Notice: Subject to any disclaimer, the term of this patent is extended or adjusted under 35 U.S.C. 154(b) by 321 days.

(21) Appl. No.: 11/704,265

(22) Filed: Feb. 9, 2007

(65) Prior Publication Data

US 2008/0191416 A1 Aug. 14, 2008

(51) Int. Cl.
*A63F 3/00* (2006.01)

(52) U.S. Cl. ..... 273/273; 273/292; 273/293; 273/236; 273/287; 434/128; 434/129; 463/16; 463/17; 463/18; 463/19

(58) Field of Classification Search ..... 273/273, 273/272, 292, 267, 293, 269, 287; 463/16–19; 434/128–129
See application file for complete search history.

(56) References Cited

U.S. PATENT DOCUMENTS 3,892,409 A * 7/1975 Herbert, Jr. ..... 273/271
4,498,869 A * 2/1985 Faison ..... 434/184
4,807,885 A * 2/1989 Chamblee et al. ..... 273/292
5,743,740 A * 4/1998 Visser et al. ..... 434/128
6,287,197 B1 * 9/2001 Dickinson et al. ..... 463/31
6,446,968 B1 * 9/2002 Koch ..... 273/243
6,641,402 B2 * 11/2003 Boggs ..... 434/236
6,722,655 B1 * 4/2004 Camero ..... 273/269
6,746,017 B2 * 6/2004 Yu et al. ..... 273/273
2004/0056421 A1 * 3/2004 Chiu et al. ..... 273/292
2006/0125180 A1 * 6/2006 LaRose ..... 273/292

OTHER PUBLICATIONS

"Uno card game", 2003, Mattel, Inc. [Online] <http://www.mattelgamefinder.com/rules/uno(eng).pdf>.*

* cited by examiner

*Primary Examiner*—Gene Kim
*Assistant Examiner*—Alexander R Niconovich

(57) ABSTRACT

A method of playing a card match game including providing a set of boards including a plurality of boards that each include a front face that includes a plurality of objects from a predetermined object group, each object corresponding to a single one of a plurality of predetermined object classes of the object group, each object class including a plurality of categorized objects, each object class defining a common feature between all categorized objects corresponding to the respective object class, and each board excluding at least one of the categorized objects from at least one object class, the excluded categorized object being an excluded object on the front face; providing a set of cards including a front face that includes at least one of the categorized objects; and determining that at least one object of the distributed cards match the at least one excluded categorized objects of the in-play board.

10 Claims, 6 Drawing Sheets

SYSTEMS AND METHODS FOR PLAYING A CARD MATCH GAME

BACKGROUND

This invention generally relates to card games and more particularly to systems and methods for playing a card match game to challenge user speed and cognitive skills in identifying missing objects.

Generally, known card games include a deck of cards with various designs and objectives such as, but not limited to, trivia, education, entertainment, and concentration. Some known card games also include additional game pieces such as, but not limited to, a timer, dice, and a board. At least some known card games operate as learning tools in attempts to develop user cognitive skills by training user eyes and brain to recognize, analyze, and identify objects users encounter. More specifically, some known card games have been developed in attempts to train user eyes and brain to identify only objects that are present. For example, some known card games focus on identifying objects that are present by instructing players to match colors, numbers, and/or number sequences to win the game.

At least some known card games have also been developed in attempts to train the eyes and brain to identify missing objects. Such known card games also attempt to develop user cognitive skills. Generally, known card games that focus on identifying present objects and/or identifying missing objects are complex, age restrictive, difficult to learn, difficult to play, and/or inconvenient for travel.

SUMMARY

A method of playing a card match game is provided. The method includes providing a set of boards including a plurality of boards, each board including a back face and an opposing front face, the front face including a plurality of objects from a predetermined object group, each object corresponding to a single one of a plurality of predetermined object classes of the object group, each object class including a plurality of categorized objects, each object class defining a common feature between all categorized objects corresponding to the respective object class, and each board excluding at least one of the categorized objects from at least one object class, the excluded categorized object being an excluded object on the front face. The method also includes providing a set of cards including a plurality of cards, each card including a back face and an opposing front face, the front face including at least one of the categorized objects. The method further includes playing the card match game including (a) distributing a plurality of the cards to each of at least one player; (b) orientating the boards such that the front face of each board is hidden; (c) revealing the front face of a next one of the hidden boards, the next board being an in-play board; (d) determining at least one of the excluded categorized objects of the in-play board; (e) determining that at least one object of the distributed cards match the at least one excluded categorized objects; and (f) discarding the matching distributed card.

A method of playing a card match game. The method includes providing a set of boards including a plurality of boards, each board including a back face and an opposing front face, the front face including a plurality of objects from a predetermined object group, each object corresponding to a single one of a plurality of predetermined object classes of the object group, each object class including a plurality of categorized objects, each object class defining a common feature between all categorized objects corresponding to the respective object class, and each board excluding at least one of the categorized objects from each object class, the excluded categorized object being an excluded object on the front face. The method also includes providing a set of cards including a plurality of cards, each card including a back face and an opposing front face, the front face including at least one of the categorized objects. The method further includes playing the card match game including (a) distributing a plurality of the cards to each of at least one player; (b) orientating the boards such that the front face of each board is hidden; (c) revealing the front face of a next one of the hidden boards, the next board being an in-play board; (d) determining at least one of the excluded categorized objects of the in-play board; (e) determining that at least one object of the distributed cards match the at least one excluded categorized objects; and (f) discarding the matching distributed card.

A method of playing a card match game. The method includes providing a set of boards including a plurality of boards, each board including a back face and an opposing front face, the front face including a plurality of objects from a predetermined object group, each object corresponding to a single one of a plurality of predetermined object classes of the object group, each object class including a plurality of categorized objects, each object class defining a common feature between all categorized objects corresponding to the respective object class, and each board excluding at least one of the categorized objects from each object class, the excluded categorized object being an excluded object on the front face. The method also includes providing a set of cards including a plurality of cards, each card including a back face and an opposing front face, the front face including at least one of the categorized objects from each object class. The method further includes playing the card match game including (a) distributing a plurality of the cards to each of at least one player; (b) orientating the boards such that the front face of each board is hidden; (c) revealing the front face of a next one of the hidden boards, the next board being an in-play board; (d) determining at least one of the excluded categorized objects of the in-play board; (e) determining that at least one object of the distributed cards match the at least one excluded categorized objects; and (f) discarding the matching distributed card.

BRIEF DESCRIPTION OF THE DRAWINGS

Various exemplary embodiments of this invention will be described in detail, with reference to the following figures, wherein:

FIG. 2 illustrates one exemplary embodiment of a set of draw boards of the exemplary card match game;

DETAILED DESCRIPTION OF EMBODIMENTS

The following detailed description illustrates one exemplary embodiment of the systems and methods for playing a card match game.

Figure 1:
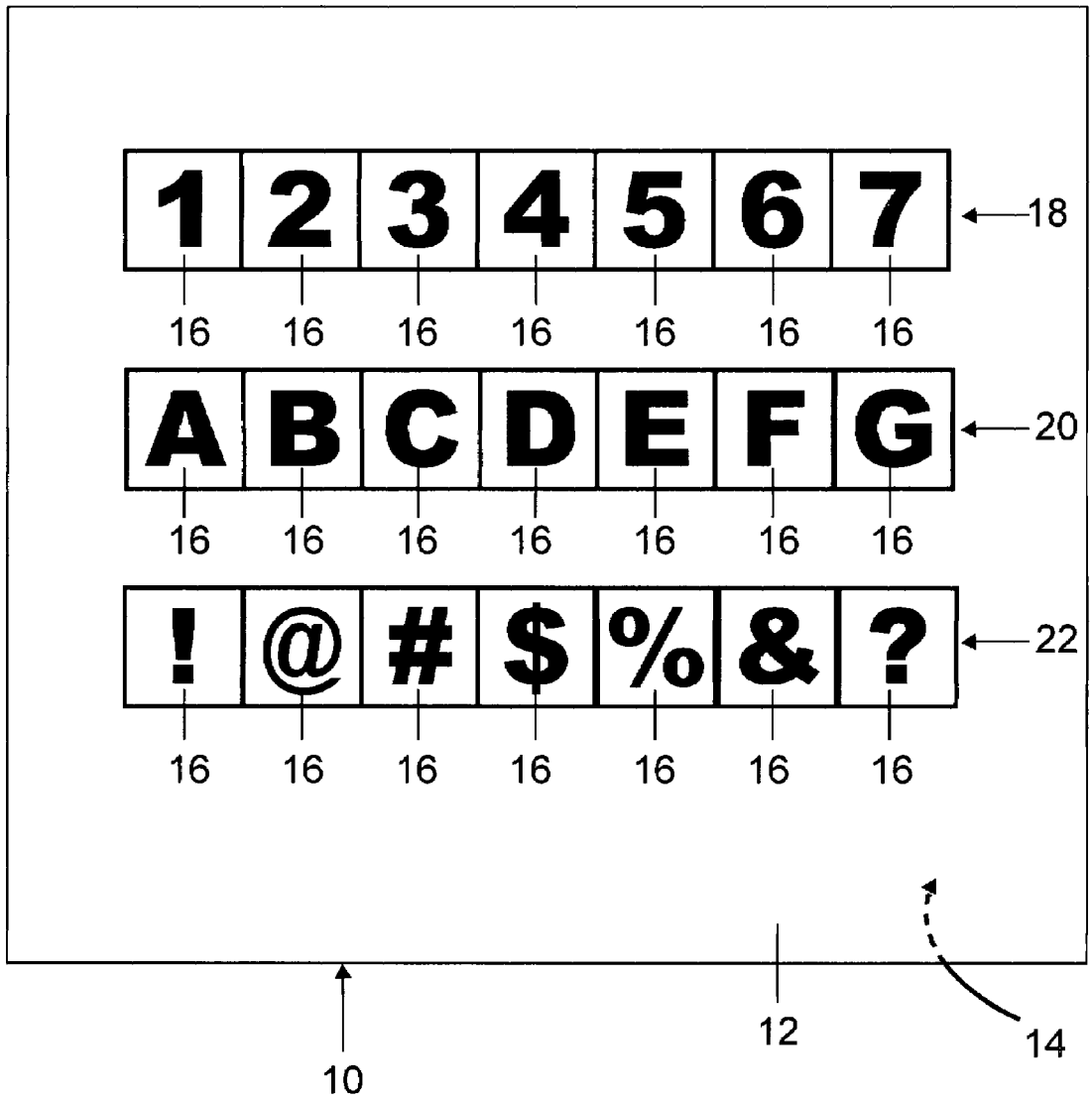
FIG. 1 illustrates one exemplary embodiment of a reference sheet of an exemplary card match game.

FIG. 1 illustrates a plan view of one exemplary embodiment of a reference sheet 10 of an exemplary card match game. As shown in FIG. 1, the reference sheet 10 includes a front face 12 and an opposing back face 14. The front face 12 graphically displays a predetermined object group including a plurality of objects 16 that are each categorized in one of a plurality of object classes 18, 20, 22 used to identify objects 16 with a common feature. For example, in the exemplary embodiment, a first object class 18 (number object class) includes seven objects 16 that are all numbers, a second object class 20 (letter object class) includes seven objects 16 that are all letters, and a third object class 22 (symbol object class) includes seven objects 16 that are all keypad symbols.

Although object classes 18, 20, 22 include an equal number of objects 16, it should be appreciated that any number of object classes and objects may be provided that facilitate the exemplary methods of playing the card match game as discussed in detail below. It should also be appreciated that objects can be any identifiable marking such as, but not limited to, words, symbols, shapes, letters, numbers, patterns, icons, colors, indicia, and any combination thereof. It should further be appreciated that the objects can be displayed with or without defined borders. It should also be appreciated that the objects can be graphically displayed on the reference sheet by any suitable means such as, but not limited to, markers, crayons, engraving, handwriting, and computer generated printing. It should also be appreciated that the reference sheet is fabricated from any suitable material such as, but not limited to, paper, cardboard, and plastic. It should further be appreciated that reference sheet may be any number, size, shape, and/or color. It should also be appreciated that a back face of the reference card may be blank or may include other indicia.

In the exemplary embodiment, the objects 16 corresponding to each respective object class 18, 20, 22 include a common feature that is different from objects 16 in the other object classes 18, 20, 22. Therefore, the reference sheet 10 graphically displays, lists, and/or categorizes all of the objects 16 by respective object classes 18, 20, 22, which are to be used to identify missing objects 16 of a draw board of the exemplary card match game as discussed in detail below.

Figure 2:
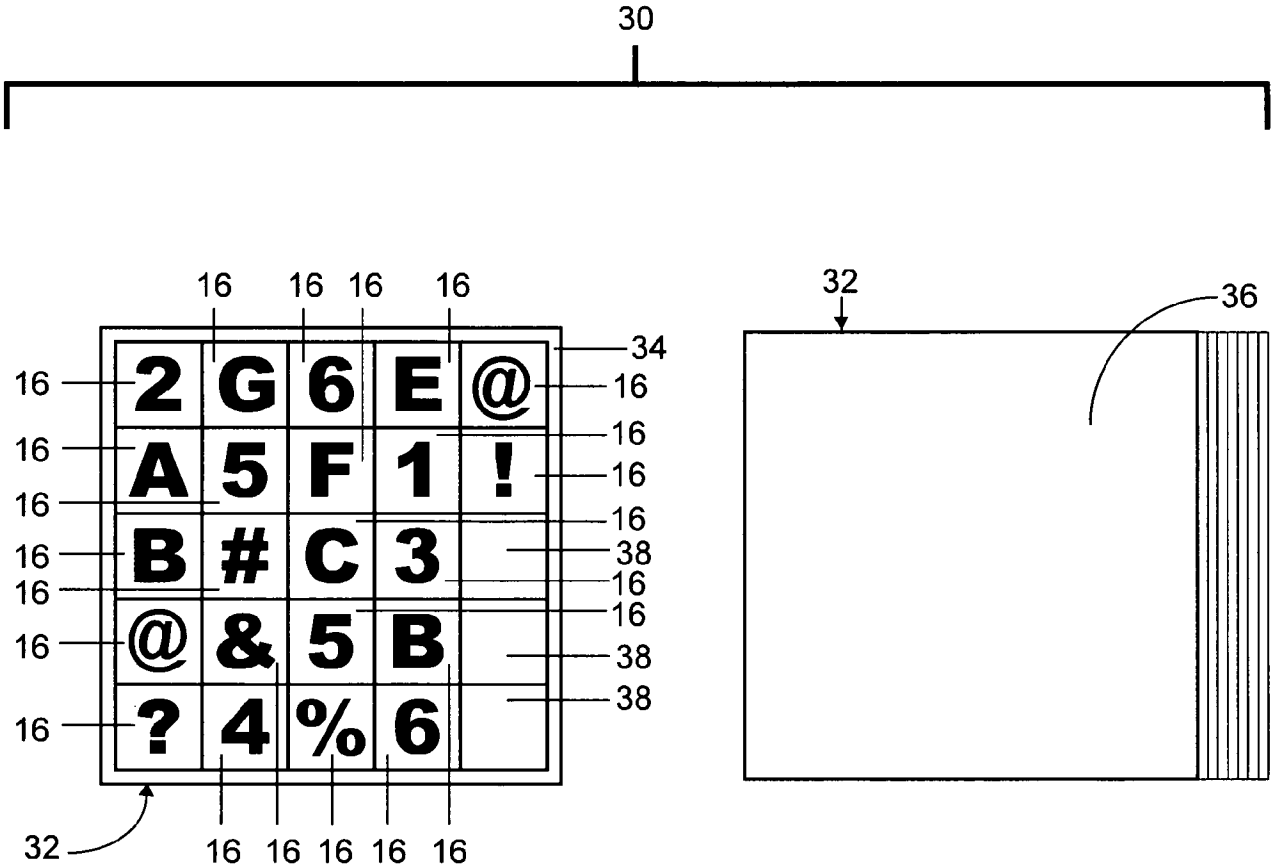
FIG. 2 illustrate

FIG. 2 illustrates a plan view of one exemplary embodiment of a set 30 of draw boards 32 of the exemplary card match game. Each draw board 32 corresponds to a common board that may be shared by all players during play such that the players may match play cards as discussed in detail below. As shown in FIG. 2, each draw board 32 includes a front face 34 and an opposing back face 36. The front face 34 includes a plurality of the objects 16 that were previously identified with respect to reference card 10 (shown in FIG. 1). In the exemplary embodiment, the objects 16 provided on front face 34 exclude one corresponding object 16 from each of the three defined object classes 18, 20, 22 (shown in FIG. 1). Each excluded object 38 represents an object 16 that is identified in the object classes 18, 20, 22 (shown in FIG. 1), but is missing from a revealed draw board 32. It should be appreciated that excluded object 38 may be represented by, for example, a blank space or box.

It should be appreciated that that any suitable number of objects may be excluded from any of draw board. It should also be appreciated that objects may be provided at any location and/or in any orientation on the draw boards. It should further be appreciated that the objects provided on each draw board may differ between draw boards. It should also be appreciated that the draw boards are fabricated from any suitable material such as, but not limited to, paper, cardboard, and plastic. It should also be appreciated that the draw boards may be any number, size, shape, and/or color. It should further be appreciated that a back face of each draw board may be blank or may include other indicia.

Figure 3:
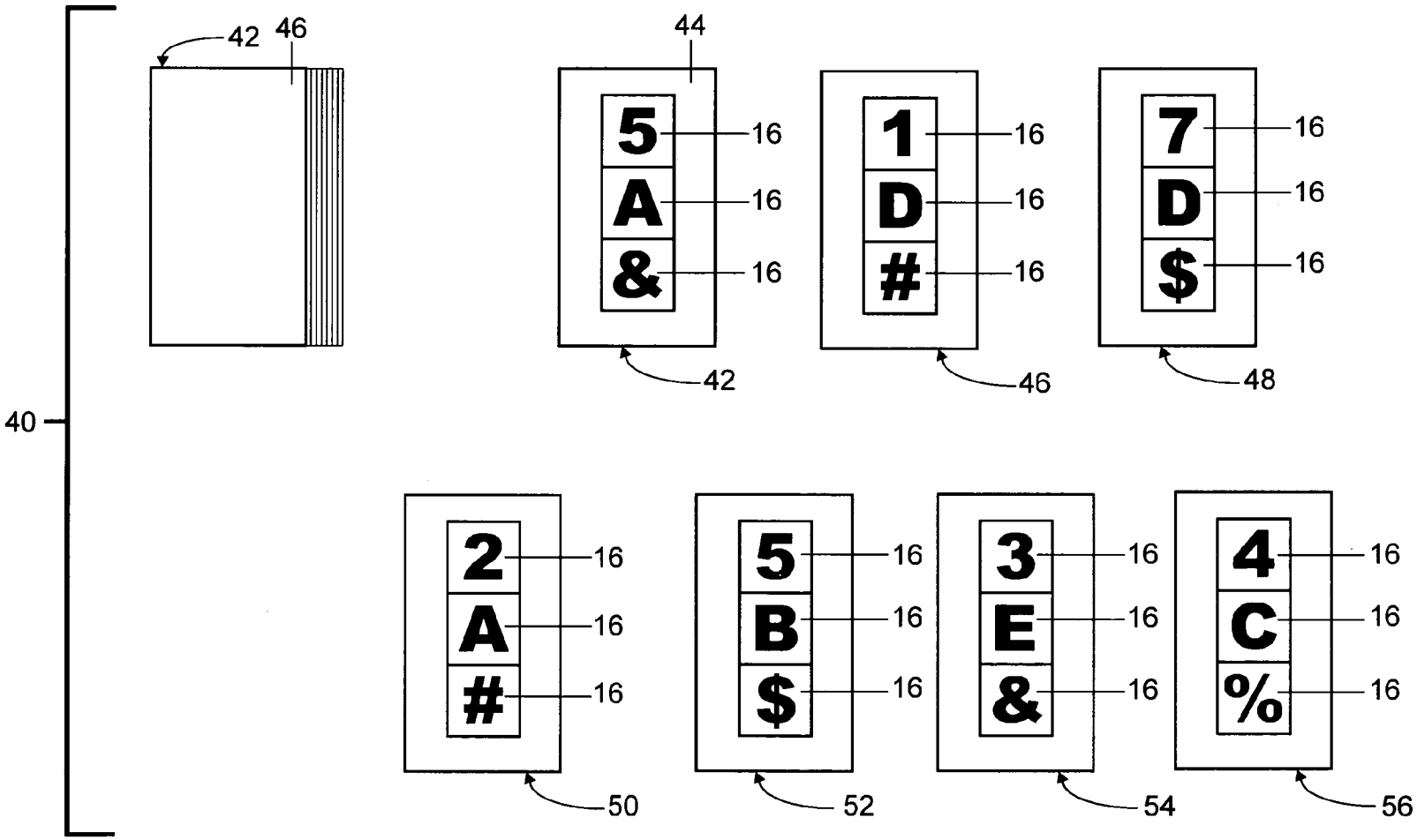
FIG. 3 illustrates one exemplary embodiment of a set of play cards of the exemplary card match game.

FIG. 3 illustrates a plan view of one exemplary embodiment of a set of play cards 40 of the exemplary card match game. As shown in FIG. 3, play card 42 includes a front face 44 and an opposing back face 46. Play cards 56, 48, 50, 52, 54, and 56 similarly include front and back faces. For ease of understanding, play card 42 will be described in greater detail. However, it should be appreciated that the following description of play card 42 similarly applies to all play cards that include various objects 16.

As shown in FIG. 3, the front face 44 of play card 42 includes a plurality of the objects 16 that were previously identified with respect to reference card 10 (shown in FIG. 1). In the exemplary embodiment, one object 16 is provided from each of object classes 18, 20, 22 (shown in FIG. 1). Although providing one object from each identified object class is preferable, it should be appreciated that a single object may be provided on a front face of a play card.

It should also be appreciated that objects may be provided at any location and/or in any orientation on a front face of the play cards. It should further be appreciated that objects provided on each play card may differ between play cards. It should also be appreciated that the play cards are fabricated from any suitable material such as, but not limited to, paper, cardboard, and plastic. It should also be appreciated that play cards may be any number, size, shape, and/or color. It should further be appreciated that a back face of each play card may be blank or may include other indicia.

In the exemplary embodiment shown in FIG. 3, the front faces 44 of each of the seven play cards 42, 46, 48, 50, 52, 54, and 56 represent one player's dealt-hand. It should be appreciated that a dealt-hand may include any number of play cards that facilitate the method of playing the card match game as discussed in detail below.

Figure 4:
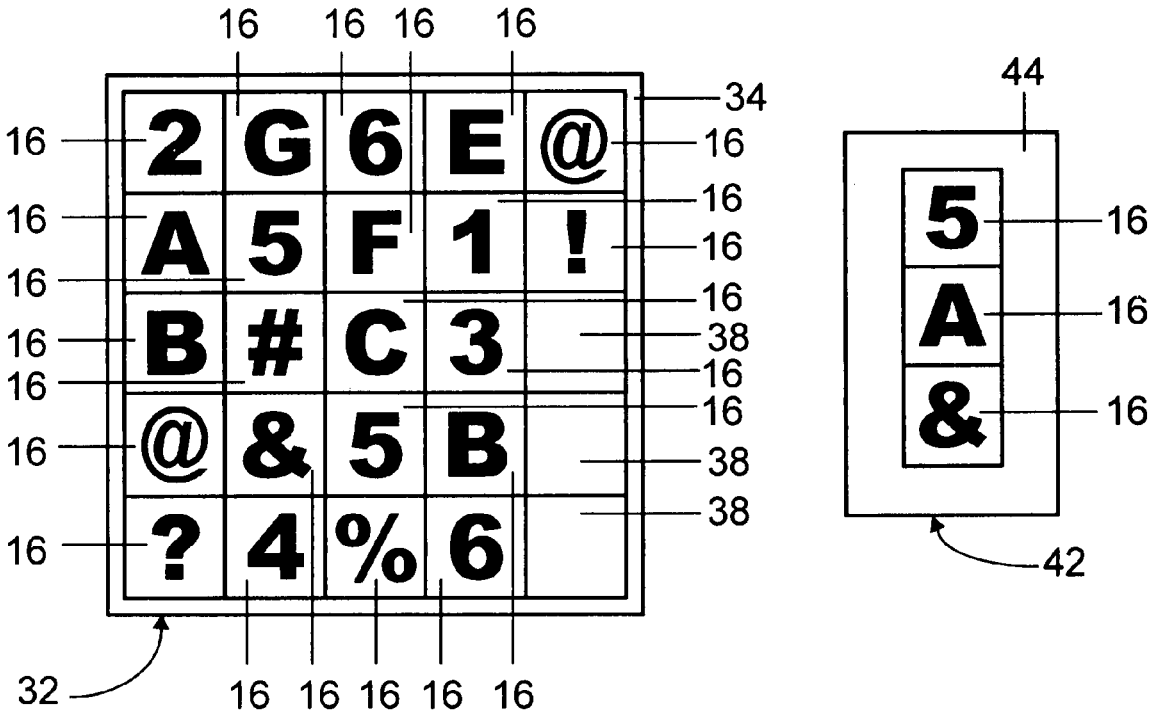
FIG. 4 illustrates one exemplary embodiment of a draw board and a play card combination of the exemplary card match game.
Figure 5:
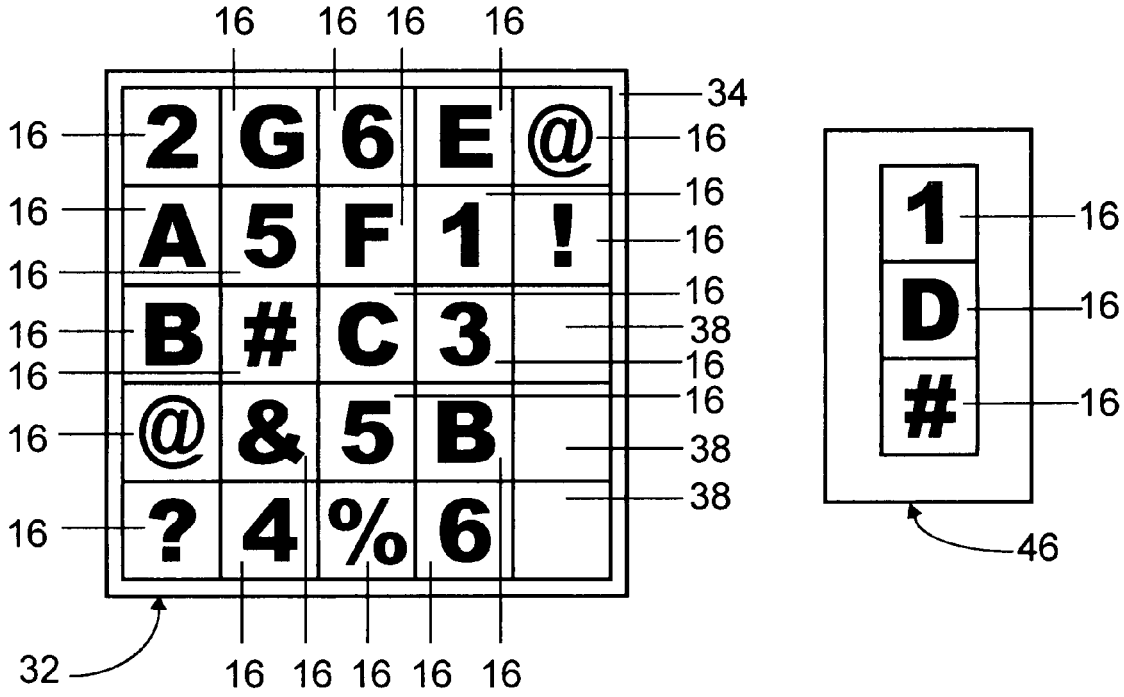
FIG. 5 illustrates one exemplary embodiment of a draw board and an object play card combination of the exemplary card match game.
Figure 6:
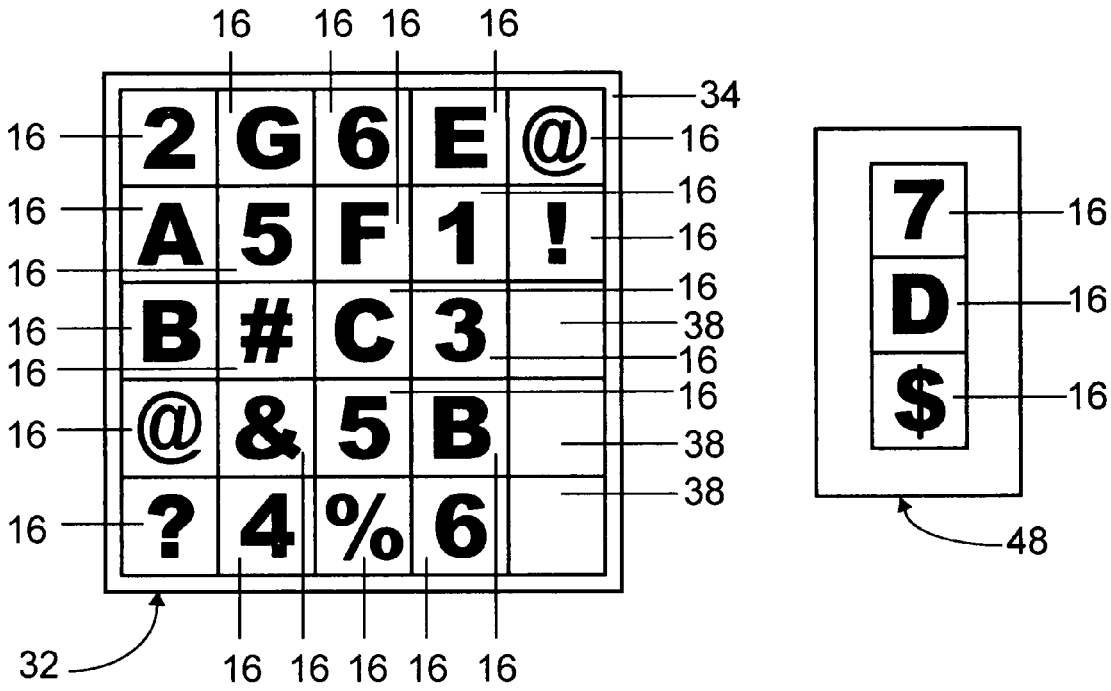
FIG. 6 illustrates one exemplary embodiment of a draw board and a super play card combination of the exemplary card match game.

FIGS. 4-6 are used to illustrate an exemplary method of playing a card match game according to one exemplary embodiment. FIG. 4 illustrates a plan view of one exemplary embodiment of a draw board and non-matching play card combination of the exemplary card match game. FIG. 5 illustrates a plan view of one exemplary embodiment of draw board and object play card combination of the exemplary card match game. FIG. 6 illustrates a plan view of one exemplary embodiment of a draw board and a super play card combination of the exemplary card match game. At least one concept of the exemplary method of playing a card match game is for players to identify all objects 16 of a revealed in-play draw boards 32, quickly identify excluded objects 38 (which are defined blank spaces on the in-play draw 32, representing objects 16 that are missing from or non-matching the front faces 34 of the in-play draw board 32, determine that at least one object of the distributed play cards does not match any of the plurality of objects of the in-play board, and discard the non-matching distributed card, which is a dealt play card that includes an object 16 corresponding to at least one of the excluded objects 38. Non-matching play cards may potentially be properly discarded to the discard pile.

During initial game set-up, the draw board set 30 (shown in FIG. 2) is oriented such that the front faces 34 of each draw board 32 is hidden from each player's view in the first step. For example, in the exemplary embodiment, the draw boards 32 are oriented such that the front faces 34 face down. Likewise, the play card set 40 (shown in FIG. 3) is placed such that the front faces 44 of each play card are hidden from each player's view in the second step. For example, in the exemplary embodiment, the play cards are oriented such that the front faces 44 face down. A same number of play cards is distributed from the play card set 40 to each player such that each player obtains a dealt hand, such as but not limited to, the dealt hand obtained by one player (shown in FIG. 3).

After players receive and view the respective dealt hand, a next face down draw board 32 is revealed or flipped from the downward facing set 30 in the third step. The next revealed draw board 32 combined with remaining dealt plays cards, such as play cards 42, 46, 48, 50, 52, 54, 56, constitute game components that are in-play. In the fourth step, each player views the respective dealt hand to determine whether at least one object 16 provided on the respective play cards include at least one excluded object 38 that is identified in the object classes 18, 20, 22 (shown in FIG. 1), but is missing from or non-matching the objects on the revealed draw board 32. In the fifth step, any player that plays a non-matching card first, may properly discard the non-matching card from the respective dealt hand to a discard pile (not shown). Properly discarded play cards are no longer considered in-play. Prior to repetition of the third step, other players that subsequently play a play card shall return such play card to remaining cards in the respective dealt hand so that such play card is still in-play. Afterward or if none of the players have a non-matching play card, a next round repeats the first through sixth steps until one of the players properly discards all of the respective play cards to end the game.

As shown in the exemplary embodiment of FIG. 4, play card 42 represents a matching play card that may not be discarded with respect to draw board 32 because none of the objects 16 on play card 42 represent an excluded object 18 that is identified in the object classes 18, 20, 22 (shown in FIG. 1), but is missing from the revealed draw board 32. For example, the excluded objects 18 missing from the front face 34 of the draw card 32 of FIG. 4 are [17], [D] and [$]. In other words, all objects 16 on play card 42 match any of the objects 16 on the draw board 32. Matching plays cards cannot be properly discarded to the discard pile.

As shown in the exemplary embodiment of FIG. 5, play card 46 represents a non-matching play card with respect to draw board 32 because at least one of the objects 16 on play card 46 represent at least one excluded object 18 that is identified in the object classes 18, 20, 22 (shown in FIG. 1), but is missing from the revealed draw board 32. For example, play card 46 includes [D] as an object 16, and the excluded objects 18 missing from the front face 34 of the draw card 32 of FIG. 4 are [7], [D] and [$]. Non-matching play cards may potentially be properly discarded to the discard pile.

As shown in the exemplary embodiment of FIG. 6, play card 48 represents a super non-matching play card with respect to draw board 32 because all of the objects on play card 48 represent all excluded objects 18 that are identified in the object classes 18, 20, 22 (shown in FIG. 1), but are missing from the revealed draw board 32. For example, play card 48 includes [7], [D] and [$] as objects 16, and the excluded objects 18 missing from the front face 34 of the draw card 32 of FIG. 4 are [7], [D] and [$]. Super non-matching play cards may potentially be properly discarded to the discard pile. It should be appreciated that a player that discards the super play card may be determined as the winner of the game.

It should be appreciated that a set of play cards may include other types of play cards such as, but not limited to, cards that prompt a player to draw additional, un-dealt play cards remaining in a hidden/face down play card set. It should also be appreciated that any conventional scoring/point system may be implemented in the exemplary methods described above. It should further be appreciated that a penalty such as, but not limited to, a subtraction or addition of points may be implemented in the above-described exemplary methods when a player plays matching play card. It should also be appreciated that a penalty such as, but not limited to, individual player distribution of undistributed cards remaining in a set may be implemented when a player plays a matching card and/or a player has no non-matching cards in the respective hand. It should also be appreciated that players may include teams of players and/or a single player.

The above-described exemplary systems and methods of playing a card match game facilitates stimulating, exercising, and training a players' eyes and brain to process visual perception to facilitate identification of missing objects in a timely manner. It should be appreciated that the exemplary system and methods may alternatively be computer-implemented.

Exemplary embodiments systems and methods of playing a card match game are described in detail above. The exemplary systems and methods are not limited to the embodiments described herein. Rather, other variations of the exemplary systems and methods may be utilized within the spirit and scope of the claims.

While the invention has been described in terms of various specific embodiments, those skilled in the art will recognize that the invention can be practiced with modification within the spirit and scope of the claims.

What is claimed is:

1. A method of playing a card match game, said method comprising:

providing a set of boards including a plurality of boards, each board including a back face and an opposing front face, the front face including a plurality of objects from a predetermined object group, each object corresponding to a single one of a plurality of predetermined object classes of the object group, each object class including a plurality of categorized objects, each object class defining a common feature between all categorized objects corresponding to the respective object class, and each board excluding at least one of the categorized objects from at least one object class, the excluded categorized object being an excluded object on the front face;

providing a set of cards including a plurality of cards, each card including a back face and an opposing front face, the front face including at least one of the categorized objects;

playing the card match game comprising:

(a) distributing a plurality of the cards to each of at least one player;

(b) orientating the boards such that the front face of each board is hidden;

(c) revealing the front face of a next one of the hidden boards, the next board being an in-play board;

(d) identifying all of the plurality objects of the in-play board;

(e) determining that at least one object of the distributed cards does not match any of the plurality of objects of the in-play board; and (f) properly discarding the non-matching distributed card, wherein the distributed cards including all objects matching any of the plurality of the in-play board may not be properly discarded.

2. The method according to claim 1, further comprising repeating steps (c)-(f) at least until the at least one player discards all distributed cards.

3. The method according to claim 1, further comprising allotting points for each object on the distributed card that does not match any of the plurality of the objects of the in-play board.

4. The method according to claim 1, wherein distributing a plurality of cards comprises distributing a same number of cards to each player.

5. The method according to claim 1, wherein discarding the non-matching distributed card comprises discarding the non-matching distributed card prior to any other player.

6. The method according to claim 1, further comprising providing a reference sheet including a back face and an opposing front face that displays the categorized objects.

7. The method according to claim 1, further comprising implementing a penalty when at least one of a matching play card is discarded.

8. The method according to claim 7, wherein implementing the penalty comprises distributing at least one remaining card undistributed from the set of cards to the discarding player of the matching card.

9. The method according to claim 7, wherein implementing the penalty comprises deducting a point to the discarding player of the matching card.

10. The method according to claim 7, providing the set of cards includes providing a non-object card that at least one of prompts a penalty on another player and represents any of the categorized objects.

* * * * *